US010527381B1

(12) United States Patent
Brand

(10) Patent No.: US 10,527,381 B1
(45) Date of Patent: Jan. 7, 2020

(54) GUN BARREL CLEANING LIGHT

(71) Applicant: Ronald Brand, Troy, MO (US)

(72) Inventor: Ronald Brand, Troy, MO (US)

( * ) Notice: Subject to any disclaimer, the term of this patent is extended or adjusted under 35 U.S.C. 154(b) by 0 days.

(21) Appl. No.: 16/387,618

(22) Filed: Apr. 18, 2019

(51) Int. Cl.

| | |
|---|---|
| ***F41A 29/00*** | (2006.01) |
| ***F21V 21/08*** | (2006.01) |
| ***F21V 23/04*** | (2006.01) |
| ***F21V 21/14*** | (2006.01) |
| ***F21V 21/32*** | (2006.01) |
| ***F21L 4/00*** | (2006.01) |
| *F21Y 115/10* | (2016.01) |

(52) U.S. Cl.
CPC ..... *F41A 29/00* (2013.01); *F21L 4/00* (2013.01); *F21V 21/0832* (2013.01); *F21V 21/145* (2013.01); *F21V 21/32* (2013.01); *F21V 23/0421* (2013.01); *F21Y 2115/10* (2016.08)

(58) Field of Classification Search
CPC .... F41A 29/00; F21V 21/0832; F21V 21/145; F21V 21/32; F21V 23/0421; F21L 4/00
See application file for complete search history.

(56) References Cited

U.S. PATENT DOCUMENTS

| | | | | |
|---|---|---|---|---|
| 4,339,200 | A | 7/1982 | Corbin | |
| 5,365,332 | A | 11/1994 | Barber, Jr. | |
| 7,168,824 | B2 * | 1/2007 | Schnell | F21L 4/06 362/186 |
| 7,234,263 | B2 | 6/2007 | Thiakos | |
| 8,079,170 | B2 | 12/2011 | Loftin | |
| 2013/0152446 | A1 | 6/2013 | Miller | |

* cited by examiner

*Primary Examiner* — Thomas M Sember

(57) ABSTRACT

A gun barrel cleaning light for illuminating the inside of a gun barrel during cleaning includes a cylindrical light housing and at least one strap configured to wrap around a gun body to secure the light housing to a gun with either a first end or a second end oriented towards a barrel of the gun. A plurality of batteries is coupled within the light housing. A proximal end of a flex tube is coupled to a light aperture of the first end. The flex tube is configured to extend into a barrel or an ejection port of the gun. An LED light is coupled to the distal end of the flex tube and is in operational communication with the plurality of batteries and a power switch to illuminate the inside of the gun.

11 Claims, 5 Drawing Sheets

GUN BARREL CLEANING LIGHT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to flashlights and more particularly pertains to a new flashlight for illuminating the inside of a gun barrel during cleaning.

BRIEF SUMMARY OF THE INVENTION

An embodiment of the disclosure meets the needs presented above by generally comprising a cylindrical light housing having a first end, a second end, and a sidewall extending therebetween to form an inner cavity. The first end is closed and has a central light aperture extending through to the inner cavity and the second end is open and threaded. At least one strap is coupled to the sidewall and has a left extension and a right extension. An inside face of the left extension has a first hook and loop fastener and an outside face of the right extension has a second hook and loop fastener. The first hook and loop fastener and the second hook and loop fastener are selectively engageable and the strap is configured to wrap around a gun body to secure the light housing to a gun with either the first end or the second end oriented towards a barrel of the gun. An end cap has an open threaded front end to selectively engage the second end of the light housing and a closed back end. A power switch is coupled to the end cap and extends through the back end. A plurality of batteries is coupled to the light housing within the inner cavity adjacent the second end. A proximal end of a flex tube is coupled to the light aperture of the first end. The flex tube is bendable at least 180° and maintains its shape unless manipulated. The flex tube is configured to extend down the barrel of the gun and insert a distal end into the barrel when the first end of the light housing is oriented towards the barrel, or alternatively to extend towards a butt of the gun and insert the distal end into an ejection port of the gun when the first end of the light housing is oriented towards the butt. An LED light is coupled to the distal end of the flex tube and is in operational communication with the plurality of batteries and the power switch.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
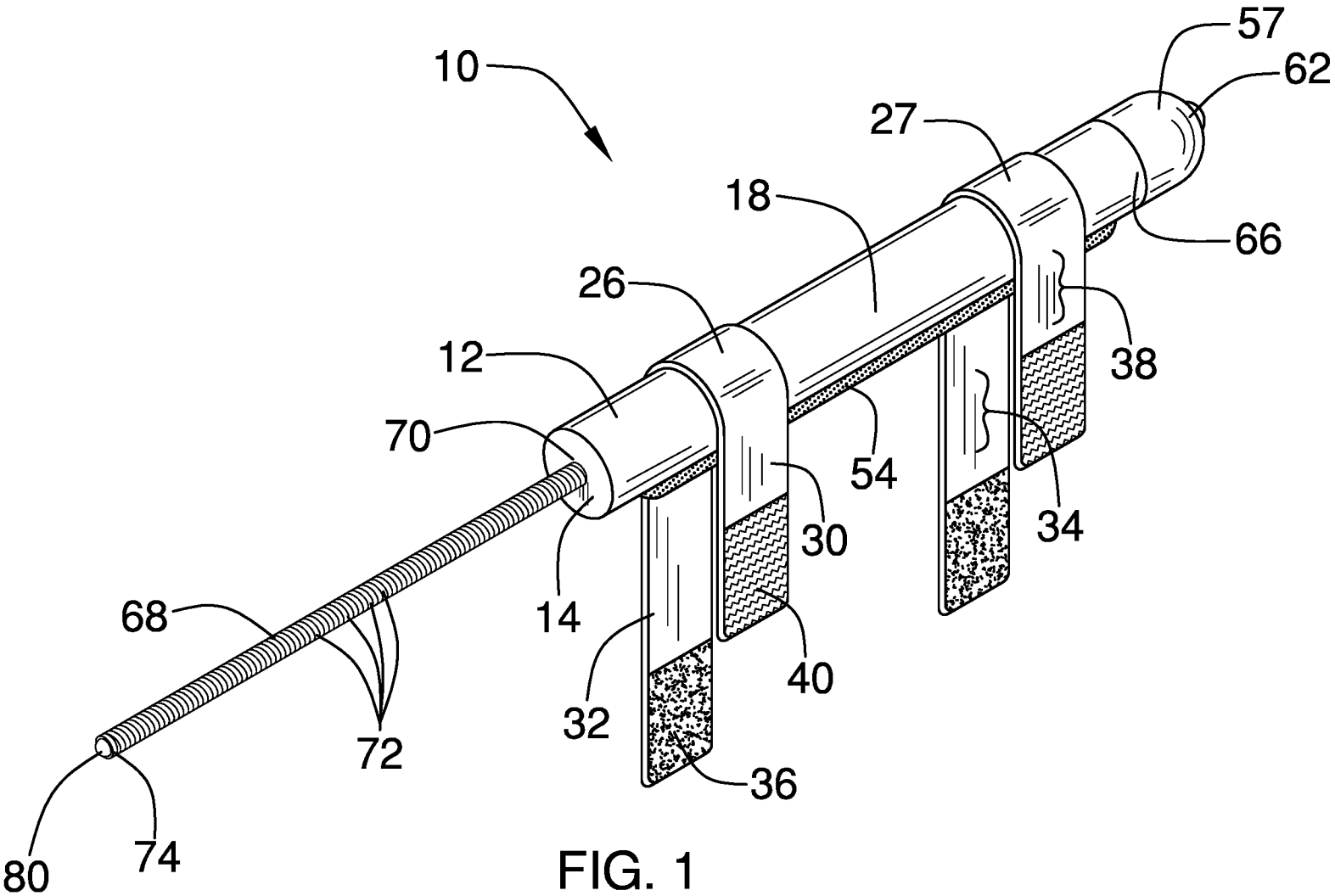
FIG. 1 is an isometric view of a gun barrel cleaning light according to an embodiment of the disclosure.
Figure 4:
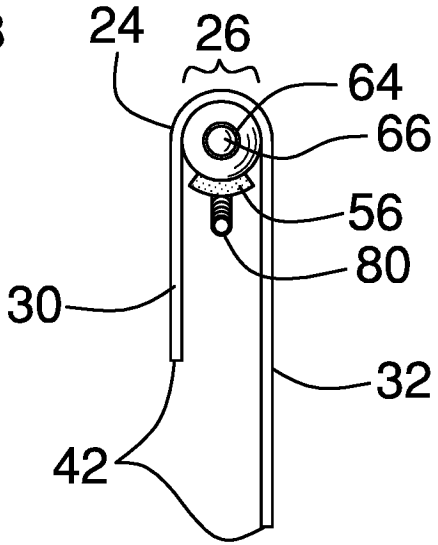
FIG. 4 is a rear elevation view of an embodiment of the disclosure.
Figure 2:
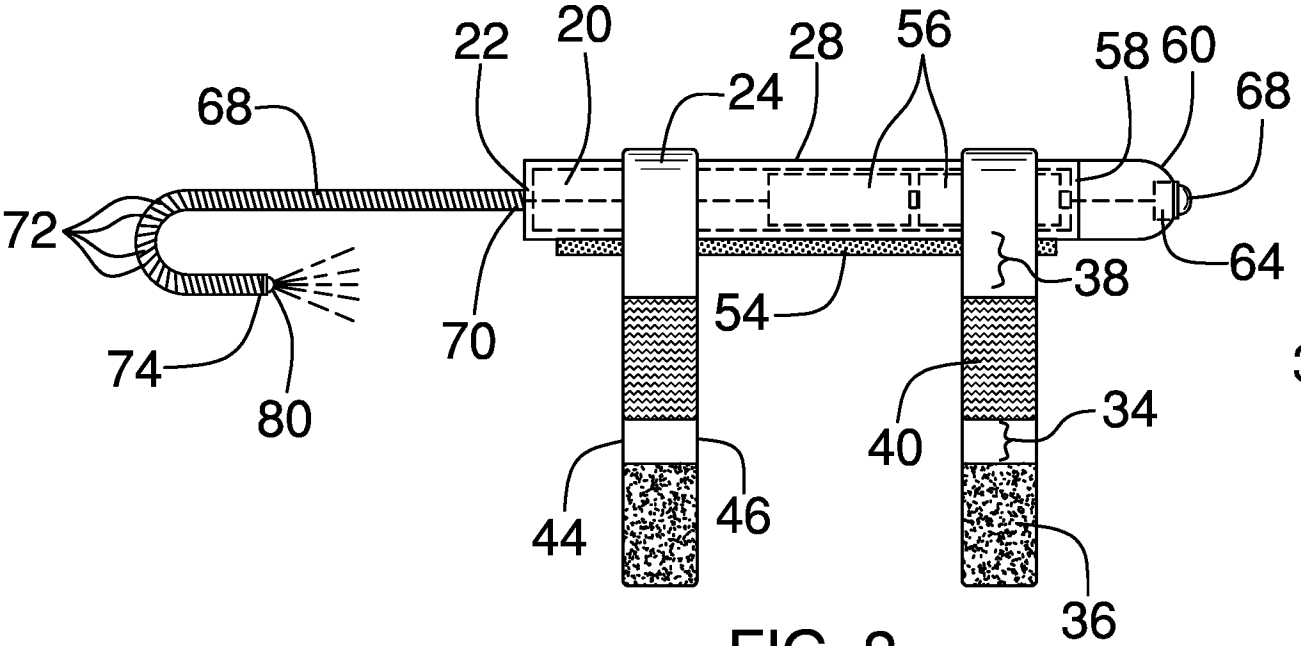
FIG. 2 is a side elevation view of an embodiment of the disclosure.
Figure 3:
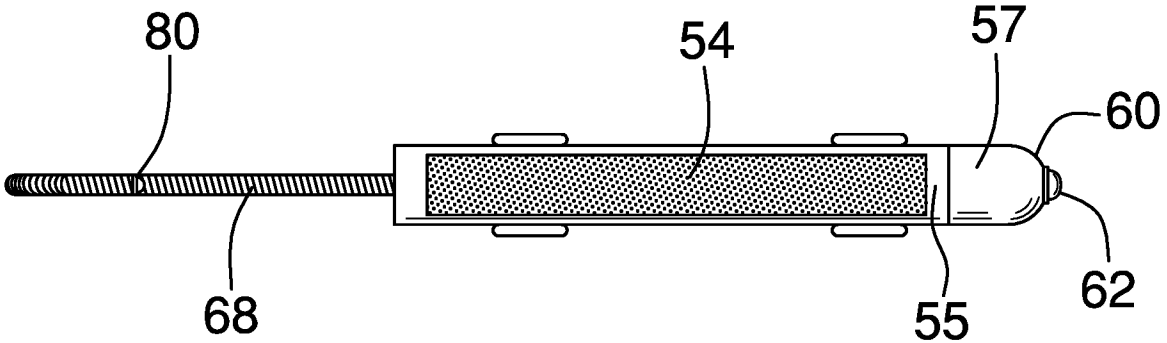
FIG. 3 is a bottom plan view of an embodiment of the disclosure.
Figure 5:
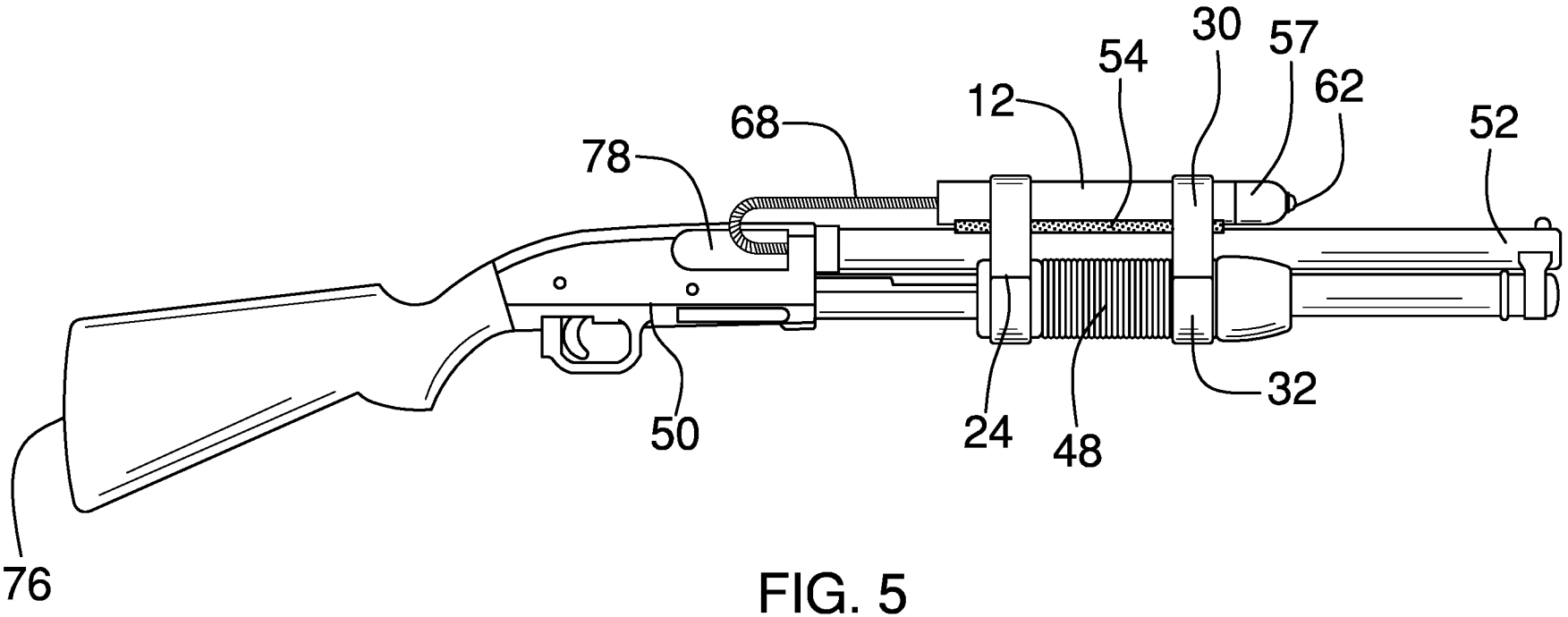
FIG. 5 is an in-use view of an embodiment of the disclosure.
Figure 6:
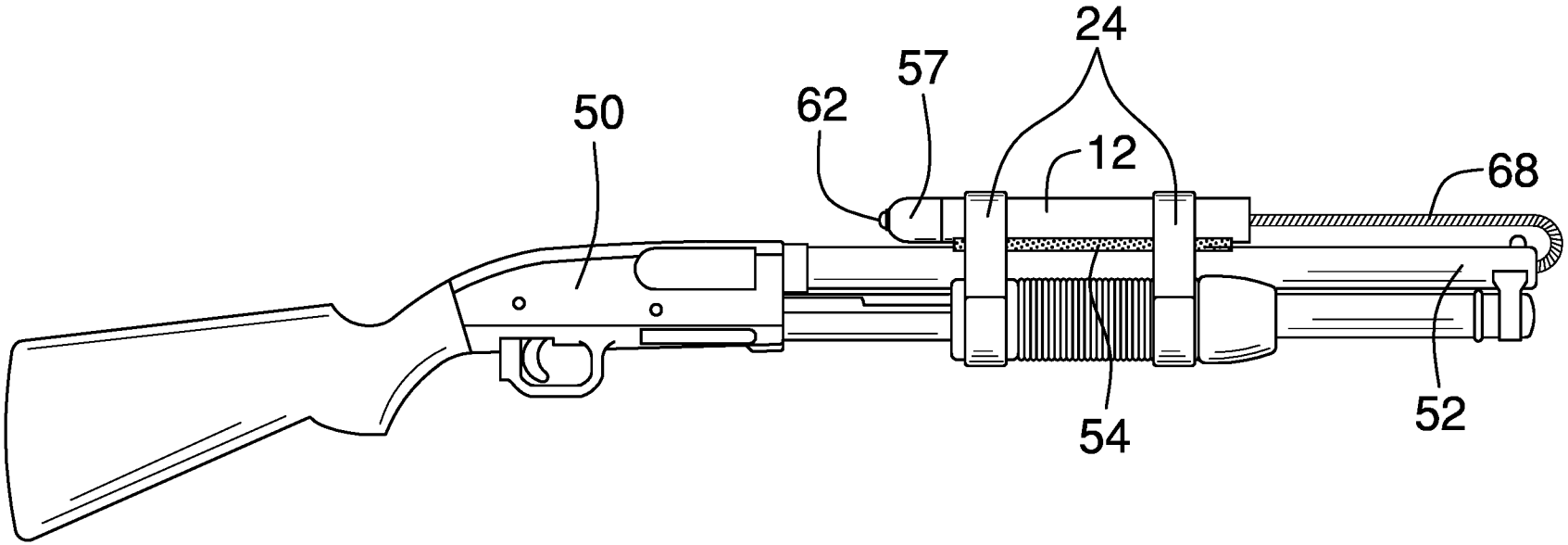
FIG. 6 is an in-use view of an embodiment of the disclosure.
Figure 7:
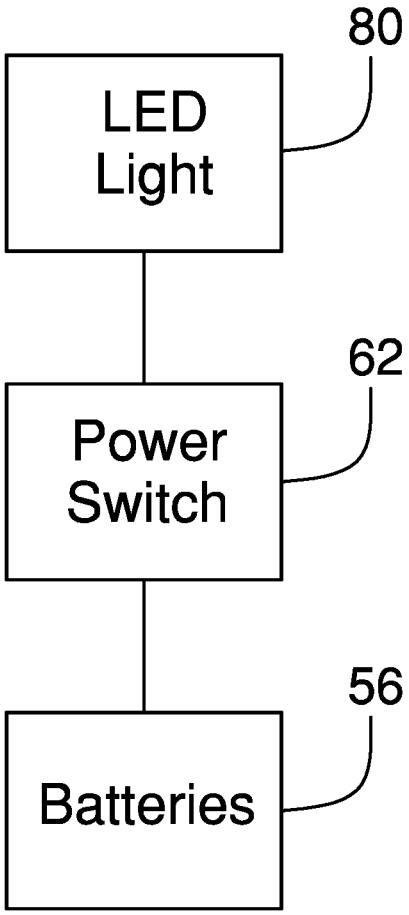
FIG. 7 is a block diagram of an embodiment of the disclosure

With reference now to the drawings, and in particular to FIGS. 1 through 7 thereof, a new flashlight embodying the principles and concepts of an embodiment of the disclosure and generally designated by the reference numeral 10 will be described.

As best illustrated in FIGS. 1 through 7, the gun barrel cleaning light 10 generally comprises a cylindrical light housing 12 having a first end 14, a second end 16, and a sidewall 18 extending therebetween to form an inner cavity 20. The first end 14 is closed and has a central light aperture 22 extending through to the inner cavity 20. The second end 16 is open and threaded.

At least one strap 24 is coupled to the light housing 12. The at least one strap 24 may be a pair of straps 24. An attachment segment 26 of each of the straps 24 is coupled to a top side 28 of the sidewall of the light housing such that the attachment segment 26 occupies an upper hemisphere of a circumference of the light housing 12 in order to prevent undesired rotation. Each strap 24 has a left extension 30 and a right extension 32. An inside face 34 of the left extension has a first hook and loop fastener 36 and an outside face 38 of the right extension has a second hook and loop fastener 40. Each of the first 36 and the second 40 hook and loop fasteners are coupled adjacent a lower end 42 of the left extension and the right extension, respectively, and extend from a front edge 44 to a rear edge 46 of the strap. The first hook and loop fastener 36 and the second hook and loop fastener 40 are selectively engageable and the strap 24 is configured to wrap around a gun body 48 to secure the light housing 12 to a gun 50 with either the first end 14 or the second end 16 oriented towards a barrel 52 of the gun. The right extension 32 has a length greater than a length of the left extension 30 to allow the first 36 and the second 40 hook and loop fasteners to meet in a more operable location on a side of the gun 50 rather than beneath the gun 50.

A protection pad 54 is coupled to a bottom side 55 of the sidewall of the light housing and extends from proximal the first end 14 to proximal the second end 16. The protection pad 54 has an arched profile extending at least 30° around the circumference of the light housing 12. The protection pad 54 is configured to provide a buffer between the light housing 12 and the gun 50 to avoid damage.

A plurality of batteries 56 is coupled within the inner cavity 20 adjacent the second end 16. An end cap 57 is coupled to the light housing 12 to seal the inner cavity 20. The end cap having an open threaded front end 58 to selectively engage the second end 16 of the light housing and a closed back end 60. The back end 60 may be rounded. A power switch 62 is coupled to the end cap 57 and comprises a circular housing 64 extending through the back end 60 and a hemispherical button 66 coupled within the circular housing 64. The power switch 62 is in operational communication with the plurality of batteries 56.

A flex tube 68 is coupled to the light housing 12. A proximal end 70 of the flex tube is coupled to the light aperture 22 of the first end 14. The flex tube 68 comprises a plurality of articulatingly coupled vertebrae 72 to be bendable at least 180° and maintain its shape unless manipulated. The flex tube 68 is configured to extend down the barrel 52 of the gun and insert a distal end 74 into the barrel 52 with the first end 14 of the light housing oriented towards the barrel 52. The flex tube 68 is alternatively configured to extend towards a butt 76 of the gun and insert the distal end 74 into an ejection port 78 of the gun with the first end 14 oriented towards the butt 76. An LED light 80 is coupled to the distal end 74 of the flex tube and is in operational communication with the plurality of batteries 56 and the power switch 62.

In use, the light housing 12 is placed with the protection pad 54 against the gun body 48 and the first 36 and the second 40 hook and loop fasteners are engaged. The flex tube 68 is then articulated to insert the distal end 74 into either the barrel 52 or the ejection port 78 depending on the orientation of the light housing 12. The power switch 62 is used to operate the LED light 80 to illuminate inside of the gun 50.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gun barrel cleaning light comprising:

a cylindrical light housing, the light housing having a first end, a second end, and a sidewall extending therebetween to form an inner cavity, the first end being closed and having a central light aperture extending through to the inner cavity, the second end being open and threaded;

at least one strap coupled to the light housing, the strap being coupled to the sidewall and having a left extension and a right extension, an inside face of the left extension having a first hook and loop fastener and an outside face of the right extension having a second hook and loop fastener, the first hook and loop fastener and the second hook and loop fastener being selectively engageable and the strap being configured to wrap around a gun body to secure the light housing to a gun with either the first end or the second end oriented towards a barrel of the gun;

an end cap coupled to the light housing, the end cap having an open threaded front end to selectively engage the second end of the light housing and a closed back end;

a power switch coupled to the end cap, the power switch extending through the back end;

a plurality of batteries coupled to the light housing, the plurality of batteries being coupled within the inner cavity adjacent the second end;

a flex tube coupled to the light housing, a proximal end of the flex tube being coupled to the light aperture of the first end, the flex tube being bendable at least 180° and maintaining its shape unless manipulated, the flex tube being configured to extend down the barrel of the gun and insert a distal end into the barrel with the first end of the light housing oriented towards the barrel, or alternatively to extend towards a butt of the gun and insert the distal end into an ejection port of the gun with the first end oriented towards the butt; and an LED light coupled to the flex tube, the LED light being coupled to the distal end of the flex tube and in operational communication with the plurality of batteries and the power switch.

2. The gun barrel cleaning light of claim 1 further comprising a protection pad coupled to a bottom side of the sidewall of the light housing, the protection pad extending from proximal the first end to proximal the second end and being configured to provide a buffer between the light housing and the gun to avoid damage.

3. The gun barrel cleaning light of claim 2 further comprising the protection pad having an arched profile extending at least 30° around a circumference of the light housing.

4. The gun barrel cleaning light of claim 1 further comprising the at least one strap being a pair of straps.

5. The gun barrel cleaning light of claim 4 further comprising each strap of the pair of straps being coupled to a top side of the light housing, the right extension having a length greater than a length of the left extension.

6. The gun barrel cleaning light of claim 1 further comprising the back end of the end cap being rounded.

7. The gun barrel cleaning light of claim 5 further comprising the power switch comprising a circular housing coupled to the back end and a hemispherical button coupled within the circular housing.

8. The gun barrel cleaning light of claim 1 further comprising each of the first and the second hook and loop fasteners being coupled adjacent a lower end of the left extension and the right extension, respectively, and extending from a front edge to a rear edge of the strap.

9. The gun barrel cleaning light of claim 1 further comprising an attachment segment of each of the straps being coupled to the light housing, the attachment segment occupying an upper hemisphere of a circumference of the light housing.

10. The gun barrel cleaning light of claim 1 further comprising the flex tube comprising a plurality of articulatingly coupled vertebrae.

11. A gun barrel cleaning light comprising:

a cylindrical light housing, the light housing having a first end, a second end, and a sidewall extending therebetween to form an inner cavity, the first end being closed and having a central light aperture extending through to the inner cavity, the second end being open and threaded;

at least one strap coupled to the light housing, the at least one strap being a pair of straps, an attachment segment of each of the straps being coupled to a top side of the sidewall of the light housing, the attachment segment occupying an upper hemisphere of a circumference of the light housing, each strap having a left extension and a right extension, the right extension having a length greater than a length of the left extension, an inside face of the left extension having a first hook and loop fastener and an outside face of the right extension having a second hook and loop fastener, each of the first and the second hook and loop fasteners being coupled adjacent a lower end of the left extension and the right extension, respectively, and extending from a front edge to a rear edge of the strap, the first hook and loop fastener and the second hook and loop fastener being selectively engageable and the strap being configured to wrap around a gun body to secure the light housing to a gun with either the first end or the second end oriented towards a barrel of the gun;

a protection pad coupled to the light housing, the protection pad being coupled to a bottom side of the sidewall of the light housing and extending from proximal the first end to proximal the second end, the protection pad having an arched profile extending at least 30° around the circumference of the light housing, the protection pad being configured to provide a buffer between the light housing and the gun to avoid damage;

an end cap coupled to the light housing, the end cap having an open threaded front end to selectively engage the second end of the light housing and a closed back end, the back end being rounded;

a power switch coupled to the end cap, the power switch comprising a circular housing coupled to the back end and a hemispherical button coupled within the circular housing;

a plurality of batteries coupled to the light housing, the plurality of batteries being coupled within the inner cavity adjacent the second end;

a flex tube coupled to the light housing, a proximal end of the flex tube being coupled to the light aperture of the first end, the flex tube comprising a plurality of articulatingly coupled vertebrae, the flex tube being bendable at least 180° and maintaining its shape unless manipulated, the flex tube being configured to extend down the barrel of the gun and insert a distal end into the barrel with the first end of the light housing oriented towards the barrel, or alternatively to extend towards a butt of the gun and insert the distal end into an ejection port of the gun with the first end oriented towards the butt; and an LED light coupled to the flex tube, the LED light being coupled to the distal end of the flex tube and in operational communication with the plurality of batteries and the power switch.

* * * * *